United States Patent [19]

Foster et al.

[11] 4,438,577

[45] Mar. 27, 1984

[54] IRONING APPARATUS SUPPORT

[75] Inventors: Edwin E. Foster; Wilbur A. Foster; Thomas E. Foster, all of Austin, Tex.

[73] Assignee: Majik-Ironers, Inc., Austin, Tex.

[21] Appl. No.: 255,888

[22] Filed: Apr. 20, 1981

[51] Int. Cl.[3] ..... D06F 71/00

[52] U.S. Cl. ..... 38/107

[58] Field of Search ..... 38/30, 104, 103, 139, 38/1.2, 31, 107; 108/28, 50

[56] References Cited

U.S. PATENT DOCUMENTS

| | | | |
|---|---|---|---|
| 2,648,146 | 8/1953 | Foster | 38/30 |
| 3,137,953 | 6/1964 | Foster | 38/30 |
| 3,303,591 | 11/1965 | Foster | 38/31 |
| 3,699,673 | 10/1972 | Foster et al. | 38/30 |
| 3,862,503 | 1/1975 | Foster et al. | 38/30 |

*Primary Examiner*—Werner H. Schroeder
*Assistant Examiner*—Andrew M. Falik
*Attorney, Agent, or Firm*—Kalish & Gilster

[57] ABSTRACT

Ironing apparatus provides supporting of a hand iron above the ironing surface of an ironing board. It includes a base for supportive disposition upon a supporting surface, upright post members extending upwardly from the base, and apparatus for securing an ironing board in a use position to one post member and proximate the other post member with the ironing surface horizontally disposed for ironing. An articulated linkage is swingably interengaged at one end with one of the post members, being extendable by articulation to positions over the ironing surface during ironing. A securement unit pivotally interconnects the other, post-remote end of the linkage with the iron for permitting its movement between first and second orientations respectively in and out of contact with the ironing board surface. The linkage is swingable about said post member and provides articulation when the iron is in its first orientation for freely permitting relocation of said iron during ironing to desired positions over said linkage surface but through operation of an elbow locking mechanism, preventing articulation when the iron is in its second orientation for maintaining the iron out of contact with the ironing board surface. The linkage telescopes for storage, suspending the iron between the post members, permitting storage even if the iron it hot.

13 Claims, 18 Drawing Figures

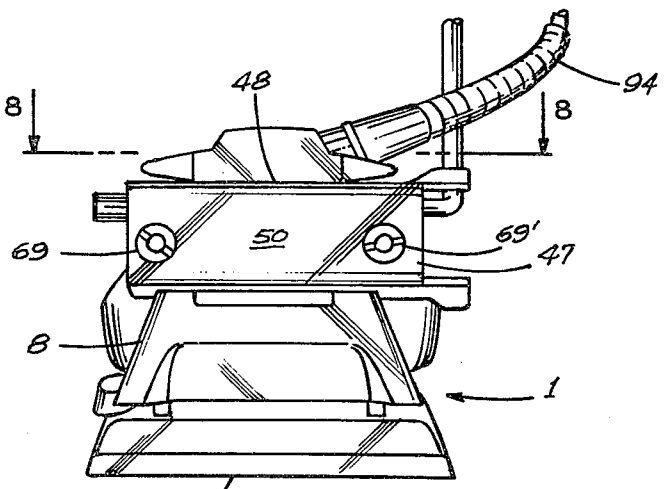
FIG. 7
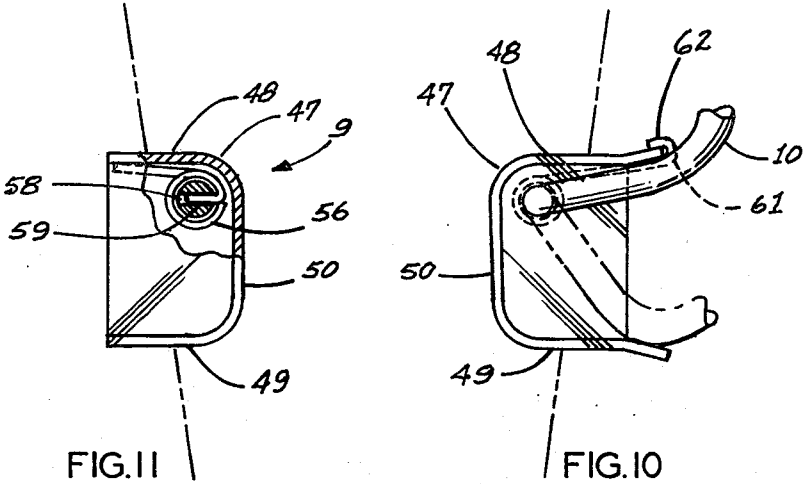
FIG. 10
FIG. 11
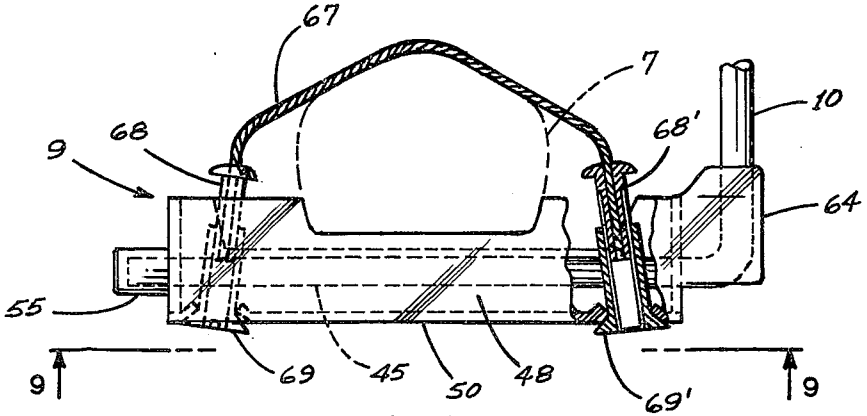
FIG. 8
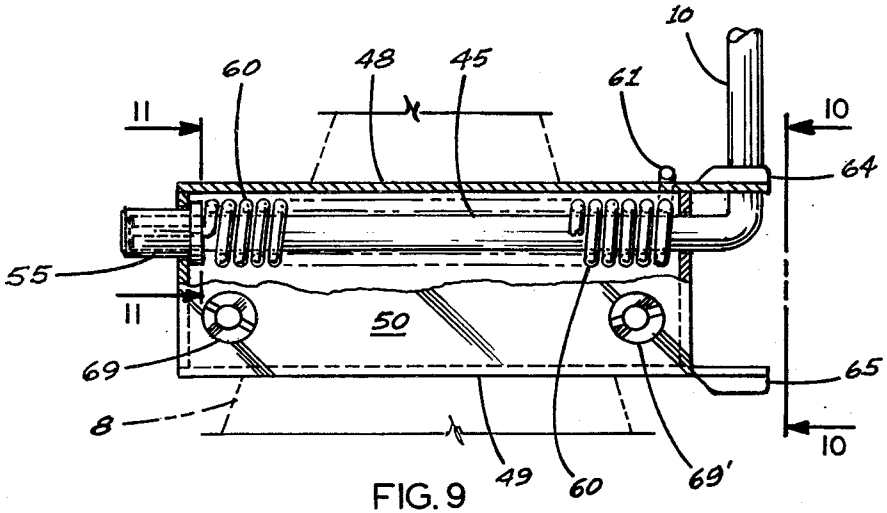
FIG. 9

IRONING APPARATUS SUPPORT

BACKGROUND AND SUMMARY OF THE INVENTION

This invention relates in general to ironing equipment and, more particularly, to a compact, collapsible ironing apparatus including means for automatic iron lifting.

The invention constitutes an improvement of the ironing apparatus set forth in U.S. Pat. No. 3,303,591, issued Feb. 14, 1967, to the present inventor.

It is an object of the present invention to provide ironing apparatus which compactly and unitarily comprises an iron, support linkage therefor, and means for supporting and securing an ironing board in conjunction with the support linkage and wherein the iron is supported in a configuration for providing extremely facile handling during ironing operations.

It is another object of the invention to provide such ironing apparatus which is of a folding nature for providing extremely compact configuration, when folded, requiring minimum storage space during disuse.

Another object of the invention is the provision of such apparatus which includes an ironing board and support means therefor which are readily moveable between storage and use orientations and are of collapsible configuration.

It is another object of the present invention to provide such ironing apparatus which is lightweight so as to be amenable to easy handling by even a small person, yet which provides extremely simple installation, unfolding and set-up for ready use, and subsequent folding for storage.

Another object of the present invention is the provision of such ironing apparatus which incorporates automatic iron supporting means so that, upon termination of any ironing movement for whatever purpose, such as for changing the work, shifting same on the board, etc., the iron is configurable in a position lifted above the board, thereby sparing the user the heretofore tedious and laborious procedure of carrying the iron to a resting place and returning same to the work.

A further object of the invention is the provision of such apparatus for providing a lifting force for the iron for resort to heavy manual lifting of the iron, and which lifting force facilitates the raising of the iron from an ironing board surface on which it is located during ironing.

It is a further object of the present invention to provide such ironing apparatus which includes provision for causing the iron to be restrained against movement, floating, or shifting if manually released when in a position lifted above the board, so that the iron will remain poised with relation to the work as presented by the user in readiness for resuming ironing operations.

A further object of the present invention is to provide such ironing apparatus which maintains components in operative condition to avoid any inadvertent, accidental or premature collapsing and yet disposing such components for easy, selective return to collapsed, stored condition.

A further object of the invention is the provision of such ironing apparatus which, upon termination of ironing operations, allows the iron to be stored while still hot without danger to persons or apparatus.

Among further objects of the present invention are the provisions of such ironing apparatus which is of simplified, economical construction, providing but few simple parts fabricated of durable materials to render the apparatus resistant to failure and breakdown; which is economical in production; which is extremely reliable in usage; and which eliminates the heretofore accepted inconvenience associated with the storing of ironing boards and ironers.

Yet another object of the invention is the provision of such ironing apparatus which may be used in conjunction with a conventional ironing board if desired, and without requiring modification of the ironing board.

It is a still further object of the present invention to provide such ironing apparatus which can be used with virtually any selected type of conventional dry or steam type iron of the hand-held variety; being amenable to facile securement to, and lifting of, irons of various different manufacturers, yet without requiring modification of the iron.

It is another object of the present invention to provide such ironing apparatus including an ironing board which is of a collapsible nature for being folded into a compact storage condition.

Other objects will be in part apparent and in part pointed out hereinbelow.

BRIEF DESCRIPTION OF THE DRAWINGS

FIG. 7 is a rear view of the spring-loaded securement device as attached to the iron.

FIG. 8 is a cross-sectional view of portions of the apparatus of FIG. 7, as taken along line 8—8 of FIG. 7, demonstrating the securement thereof to a handle member of the iron, such member being shown in phantom.

FIG. 9 is a fragmentary rear elevational view, partly in cross-section, as taken along line 9—9 of FIG. 8.

FIG. 10 is a side elevation view of the securement device taken line 10—10 of FIG. 9.

FIG. 11 is an end elevation, partly in cross-section, taken along line 11—11 of FIG. 9, of the opposite end of the securement device.

DESCRIPTION OF THE PREFERRED EMBODIMENTS

Figure 1:
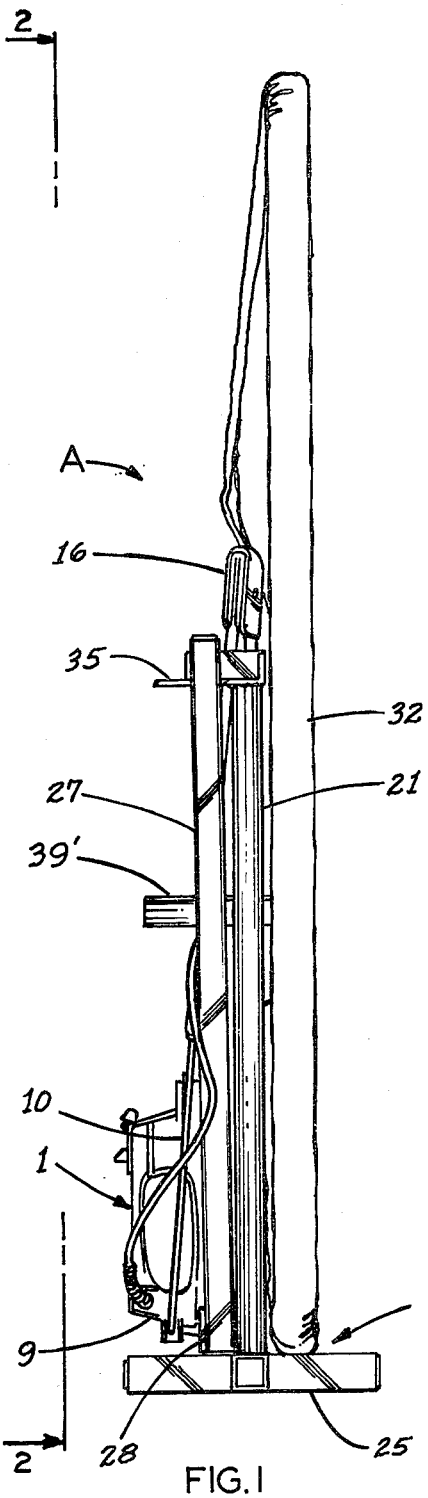
FIG. 1 is a front elevation of ironing apparatus, including an ironing board, constructed in accordance with and embodying the present invention, constituting a first embodiment.
Figure 2:
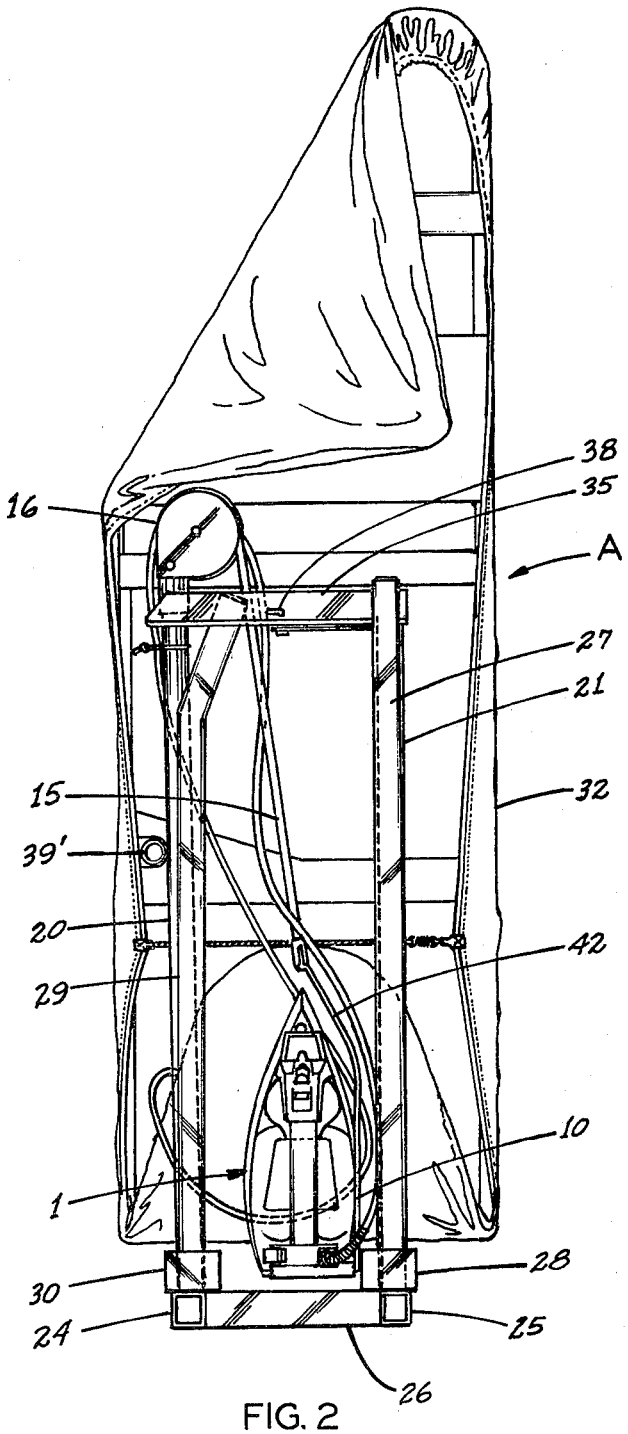
FIG. 2 is a side elevation of such embodiment as taken along line 2—2 of FIG. 1.

Referring now by reference characters to the drawings which illustrate the preferred embodiments of the present invention, A designates a first embodiment of ironing apparatus for use with a conventional hand type iron, generally designated 1, which may be a steam iron, and typical of numerous types of commercially available domestic or commercial hand irons which are presently available. In FIGS. 1 and 2, apparatus A is shown in a compact, folded state when not in use, or during storage, and with iron 1 being in a stored position until the apparatus is ready for use.

Figure 5:
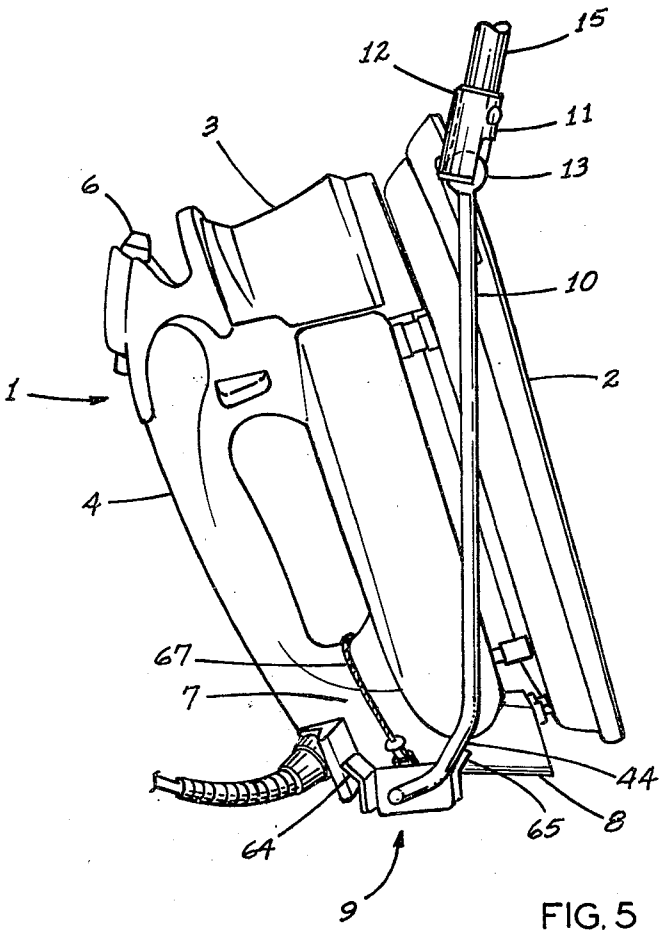
FIG. 5 is a side view of certain portions of the iron lifting mechanism including a spring-loaded securement device which provides interengagement with a standard steam iron of the conventional hand-held type, the iron being shown in a lifted position.
Figure 6:
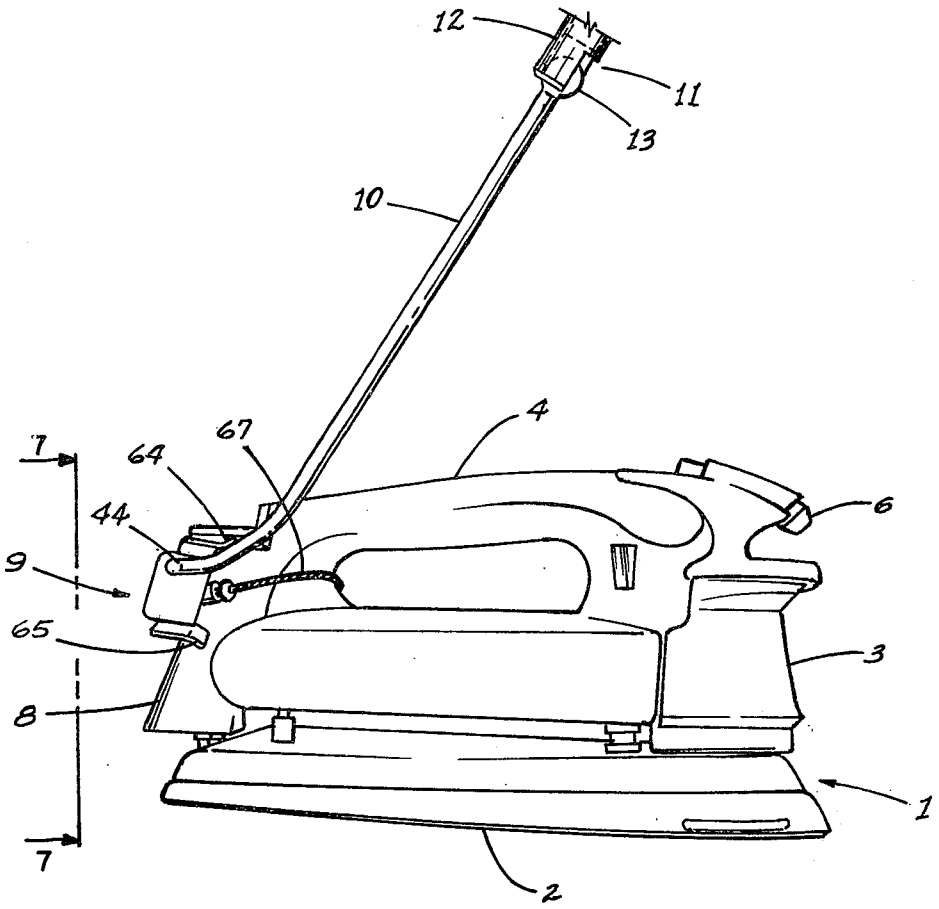
FIG. 6 is a similar side view of such apparatus and the iron being demonstrated in a lowered position as for use during the ironing operation.

Referring particularly to FIGS. 5 and 6, iron 1 has the usual sole plate 2 and body 3 having a hand grip 4 having at the forward end a steam or spray nozzle 6 and at the rear a support portion 7 of increased thickness. Portion 7 defines a base or heel 8 of the iron on which it is intended to be seated if used conventionally apart from the new apparatus, which provides lifting of the iron.

Connected to iron 1 is a securement or terminal device or unit, designated generally 9, secured by a rod 10 to a ball swivel joint 11 including a sleeve 12 clampingly engaging a ball 13 at the upper end of rod 10. Sleeve 12 is carried at the distal end of a tubular forearm member 15.

Figure 4:
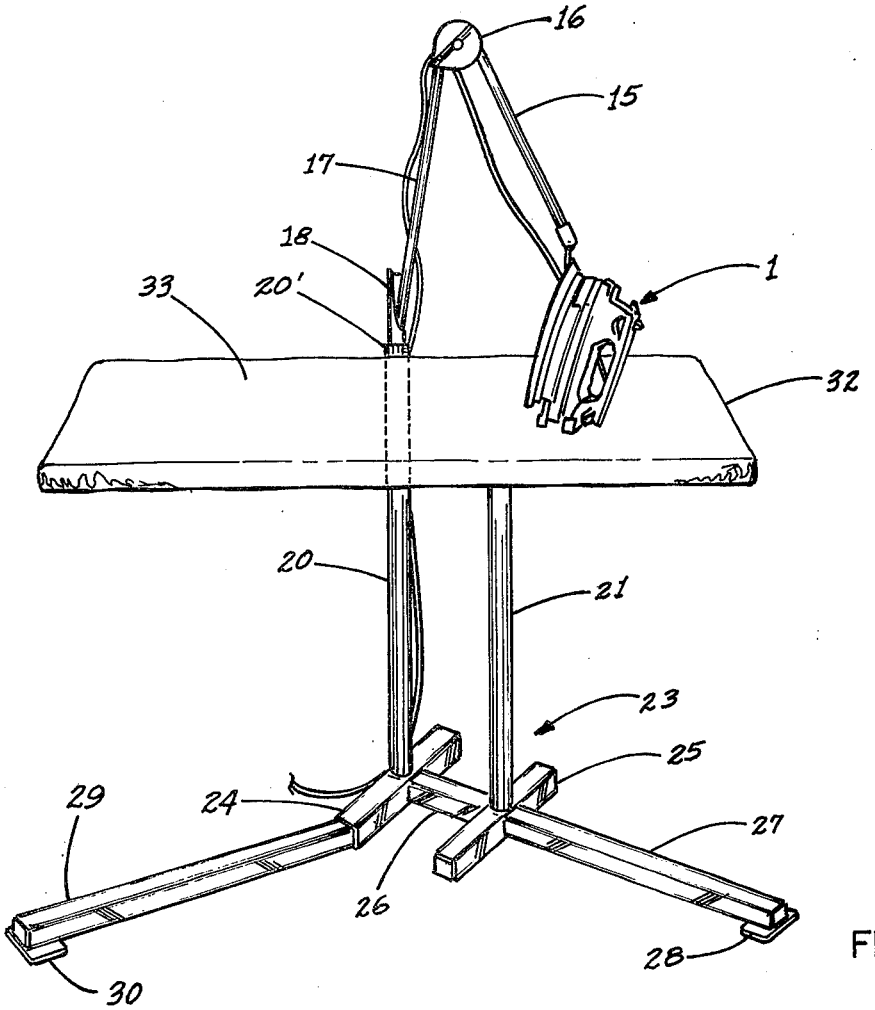
FIG. 4 is a similar perspective view of the apparatus with the iron lifting members unfolded and deployed for use and with an ironing board secured in a position of readiness for use.

Referring now to FIG. 4, which displays the ironing apparatus A in a configuration for use of iron 1 during ironing of articles of fabric, forearm 15 is seen to be pivotally secured by an elbow unit 16 in articulating relationship to a main support arm 17, also of tubular configuration, in turn pivotally secured to a tubular extension 18 telescopingly received within a tubular main support post or leg member 20. There is, thus, provided an articulating linkage pivotally connected at one end to leg 20, and swingable relative thereto and pivotally connected by securement unit 9 at the other end to iron 1. Leg member 20 is one of a pair, the other being designated 21. Legs 20, 21, being parallel, extend upwardly from a base, generally 23, having a pair of transverse tubular base members 24, 25, each of rectangular cross-section and bridged by a third tubular base member 26, also of rectangular cross-section.

Base 23 includes an opening defined by one end of member 26 for receiving an elongated length of tubing constituting a foot 27 of rectangular tubular character having rectilinear alignment with member 26 and having at its base-remote end a pad or enlarged surface support member 28. Similarly, there is provided a second foot 29 which extends outwardly from base 23 at an angle with respect to base member 24 to provide an obtuse angular relationship with foot 27 to provide a broad, stable base of support for apparatus A. Foot 29 similarly includes at its base-remote end a pad 30.

Generally, a specially configured ironing board 32 of the invention is clampingly interengaged with post or leg 21 in a manner described below to provide a rectangular ironing surface having portions which extend substantially equidistantly on opposite sides of the upper portion 20' of leg 20, from which upper portion extension 18 extends and is free to rotate therein and, thus, swing about the longitudinal axis of leg 20. The dimensions of board 32 are suitable (e.g., slightly more than 40 inches in length, as contrasted with conventional "standard" ironing boards, and having a width of slightly more than substantially half such length) for disposing arm 17 for swinging and articulating motions to present iron 1 in a supported relationship for movement over substantially all of the upper surface of ironing board 32. The latter is preferably covered by the usual heat-resistant cover and an underlying pad or resilient layer, thereby providing a smooth, continuous, substantially flat yet slightly resilient and conformal surface 33 for ironing.

As will be apparent from FIG. 4, the longitudinal axis of board 32 forms an angle relative to the longitudinal axis of bridging member 26 of the base, as well as the foot 27 extending therefrom, and with the angular relationship of foot 29 relative to base member 24 which receives it being such as to define an angle also relative to longitudinal axis of ironing board 32, which angle is substantially comparable if not equal to that formed with the longitudinal axis of ironing board 32 and foot 27.

Through a mechanism more readily apparent from the following description, arm 17 and forearm 15, by means of rod 10 and the securement device or unit 9 which clampingly engage iron 1, are adapted for providing a lifting force for maintaining iron 1 in the lifted position demonstrated in FIG. 4, when in disuse or intermediate ironing steps of the user and, thus, in an orientation providing unencumbered access to surface 33 of the ironing board for placing thereon of various articles to be ironed and yet with the iron conventionally presented for immediate utilization by lowering into contact with an article to be ironed. When the iron is in an orientation contacting the surface of ironing board 32, the articulating arm and forearm freely permit the iron to move to selected positions upon the ironing board surface, as desired during ironing operations. During such movement, arm 17 is free to swing about the longitudinal axis of leg 20.

For purposes of securing ironing board 32 to apparatus A, there is provided at the top of support leg 21 a bracket 35 of L-shaped cross-section, as by being secured at one end thereof to the upper end of leg 21. Said bracket comprises a base flange 36 of horizontal disposition and a vertical, upright flange 37. Extending upwardly through horizontal flange 36 (FIG. 3) is a locking dog or finger 38 adapted for clampingly engaging the side lip of an ironing board in a manner demonstrated shortly hereinbelow. Bracket flange 36 may be provided with an aperture 39 aligning with the bore of leg 21 for receiving a downwardly projecting tubular member 39' of the ironing board, as later explained.

This arrangement permits securement not only of the rectangular ironing board of conventional or "standard" type such as widely utilized, as more fully set forth below. Such an ironing board is designated generally in its entirety at 40 in FIG. 18 in disposition for use and secured by the clamping arrangement of bracket 35 to apparatus A, all as described hereinbelow.

Before such discussion, the features of the arrangement for securement by unit 9 of iron 1 to apparatus A and the iron support features of the apparatus are more clearly revealed.

Thus, referring to FIGS. 7–11, device 9 for securing iron 1 at the lower end of rod 10. Referring specifically to FIGS. 8 and 9, it is seen that rod 10 includes a lateral offset portion but extends downwardly throughout the major portion of its length until a point of bending rearwardly to provide a rearwardly offset portion which in turn is bent at 44 in a direction forming substantially a right angle not only with said offset portion but also with the major portion of rod 10 which extends upwardly from said offset portion, providing a transverse portion 45 of rectilinear character. Device 9 comprises a single piece of sheet metal 47 which is bent to provide a housing of U-shaped configuration, including an upper surface 48, bottom surface 49 and vertical wall surface 50. Member 47 also includes at its opposite sides plates 51, 51' which are apertured at 52, 52' for journalling of member 47 about the longitudinal axis of rod portion 45.

The distal end 54 of rod portion 45 extends well beyond plate 51 and is provided with a sleeve 55 closed at one end and having a flange 56 on the other end. The flange diameter is greater than that of aperture 52 so that it will bear against the inner surface of plate 51 and with the rod end 54 being retained within sleeve 55. Further, rod end 54 is provided with a transverse slot 58 for receiving one end 59 of a coiled torsion spring 60, having its other end 61 provided with a hook 62 for engaging a lip defined by upper surface 48 of housing member 47, whereby torsional force of the spring may be exerted upon rod relative to housing member 47.

Housing upper surface 48 has a projection 64 extending laterally beyond rod 10 for engaging rod 10 to establish a stop which limits pivotal movement of iron 1 when lowered to a use position. A lateral extension 65 of lower surface 49 similarly establishes a maximum position of rotation of the iron upward, i.e., counterclockwise as viewed in FIG. 10, when rotated about the axis of rod portion 45. Extension 65 engages the offset portion 43 of rod 10, so that the overall angular extent of movement permitted by rotation of unit 9 about the axis of rod extension 45 is somewhat greater than 90° but much less than 180°. Accordingly, iron 1 is permitted to rotate about rod portion 45 between a raised position, shown in FIG. 5, and a lowered position, shown in FIG. 6.

For securement of unit 9 to iron 1, there is provided a flexible band 67, such as of wire cable, having its ends swedged or otherwise secured within threaded fittings 68, 68'. The latter are screwed into threaded ferrules 69, 69' having enlarged diameter heads slotted for screwdriver tightening of band 67 about the handle portion 7 of the iron to grippingly secure unit 9 to the iron without any modification of the iron or damage to it. This arrangement is amenable for use with any of myriad different varieties and manufactures of irons which have an enlarged handle portion 7 by which the handle per se is affixed to the iron.

As configured for use, unit 9 is, thus, conveniently attached to the iron by the tightening of ferrules 69, 69'. Then, spring 60 is suitably pretensioned by depressing the outer, closed end of sleeve 55 to shift rod 10 to the right, as viewed in FIGS. 8 and 9, relative to housing 47. This permits the rod to clear extensions 64, 65, whereupon the iron is rotated a selected number of turns about the axis of rod portion 45 until a desired state of tension of spring 60 is achieved, preferably such as almost substantially to counterbalance the weight of iron 1 so that it will remain in the position shown in FIG. 6 in the absence of any assistance by the user but, with only the slightest upward pressure by the fingertips of the user, the iron can be caused to rotate upwardly as viewed in FIG. 5, where it remains by virtue of the relocation of the center of gravity of the iron relative to rod 10 and by engagement of tab 65 with rod portion 44. The sleeve 55, thus, permits pretensioning while allowing rod portion 45 to remain rotatably journalled within housing 47 at all times.

Figure 13:
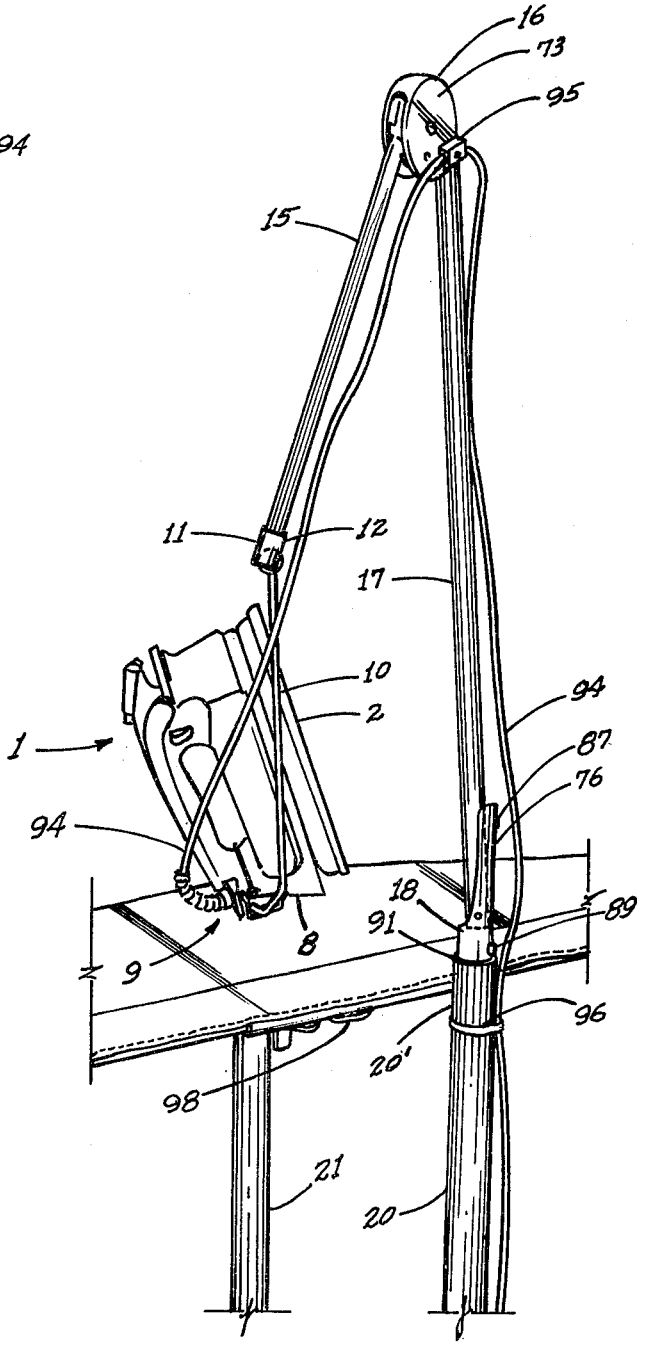
FIG. 13 is a fragmentary perspective view of portions of the apparatus and particularly of iron supporting or lifting elements as extended for use and with the iron being shown in a lifted position.
Figure 14:
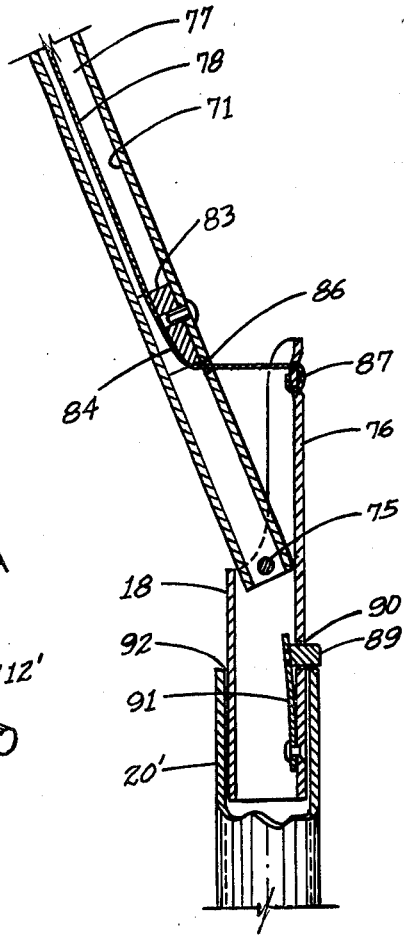
FIG. 14 is a vertical cross-section of certain supporting elements of the apparatus, including an elbow thereof.

Referring now to FIGS. 13 and 14, it is seen that swivel unit 11 permits the free orientation of rod 10 relative to the longitudinal axis of forearm 15 and provides also a wide range of permissible movement of the iron relative to forearm 15 when the latter is not utilized for the supporting of the iron, as will be the case when the iron is in its lowered position (FIG. 6) for ironing of various articles of clothing, but permitting rod 10 to hand substantially vertically downward from swivel unit 11 when the iron is supported, as demonstrated in FIG. 13, and the iron being, accordingly, positioned relative to rod 10 as shown in FIG. 5.

With reference specifically now to FIG. 14, forearm 15 is of hollow, tubular character, being preferably of circular cross-section. It is secured at its proximal end to a sheave 79 journably rotated upon a shaft 72 within a suitable housing 73. The latter is in turn secured to the distal end of main support arm 17 so that there is capability for the elbow 16 to permit articulating movement of forearm 15 with respect to support arm 17, which also is of tubular character and circular cross-section.

The proximal end of arm 17 is pivotally connected by a cross shaft or pin 75 extending transversely through tubular extension 18, which is of larger diameter than arm 17 and has a substantial semi-circular portion cut away proximate its upper end to define a half sleeve, in effect, designated at 76, against which arm 17 may lie to provide a coaxial relationship of extension 18 and arm 17 for storage purposes, but otherwise permitting arm 17 to swing downwardly, as demonstrated in FIG. 14, to form a substantial angle relative to the longitudinal axis of extension 18.

For limiting the such outward extending movement of arm 17 relative to extension 18 and also for fixing the angular relationship between arm 17 and forearm 15, there is provided a cable 78 which extends through the hollow bore 77 of arm 17, passes over sheave 79 which is d groove and includes (as at 80, on opposite sides thereof) for guiding the cable, which is secured at one end to a suitable fitting 81 carried at the proximal end of forearm 15.

Proximate the lower end of arm 17, there is provided within its bore 77 a plug 83 of circular cross-section having formed therein a groove 84 providing a generally large radius of curvature over which cable 78 passes and then extends through an aperture 86 below the plug and thence outwardly for securement by means of a screw or other fitting 87 to tubular portion 76.

It will be, therefore, appreciated that there is a fixed angular relationship provided at all times of arm 17 with respect to tubular extension 18 and for forearm 15 with respect to arm 17. If, for example, forearm 15 should be swung downwardly toward arm 17 to reduce the angle therebetween, cable 78 will be moved around sheave 79 to reduce the length of cable between securement point 87 and aperture 86 and thereby to reduce the angle between arm 17 and the longitudinal axis of tubular extension 18.

Figure 18:
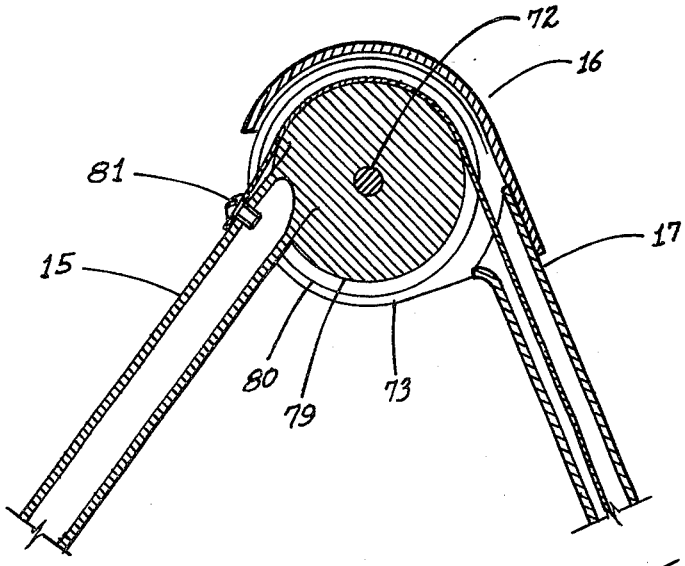
FIG. 18 is a perspective view of apparatus of the invention, as configured for lifting an iron, and interengaged with a conventional ironing board.
Figure 18:
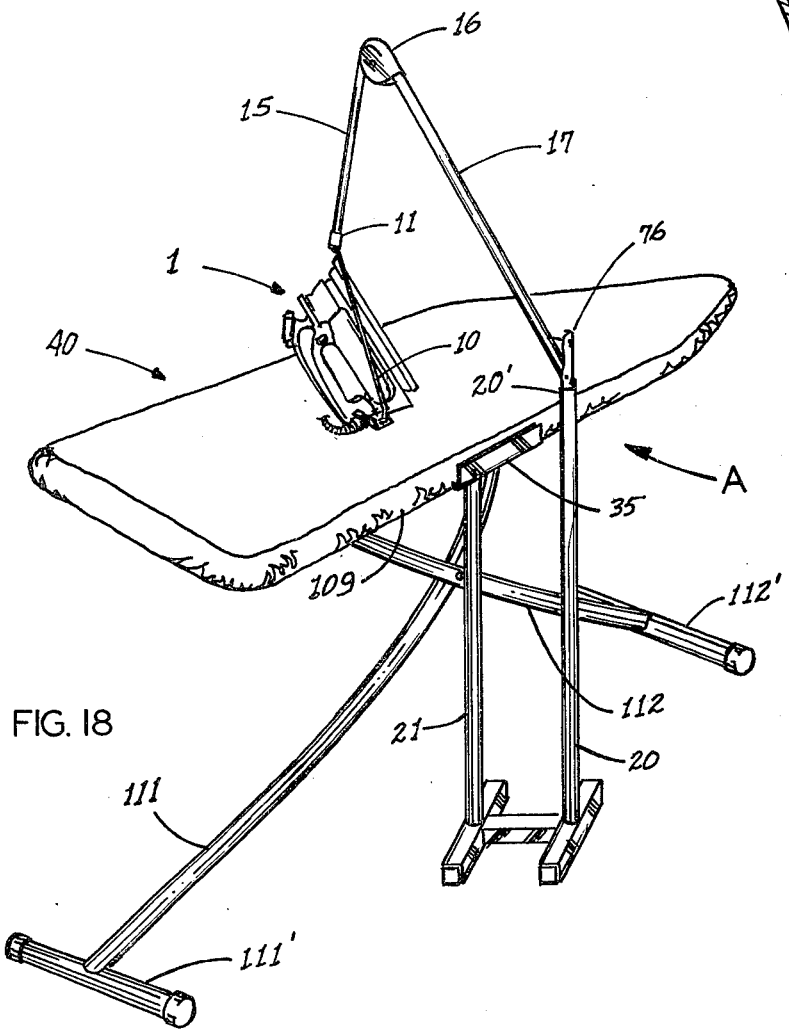

Further, when the iron 1 is in its raised position, as depicted in FIGS. 13 and 18, the weight of the iron upon forearm 15, as transferred to forearm 15 and arm 17 by means of rod 10, causes tensioning of the cable with resultant frictional force generated by cable 78 upon the surfaces of groove 84 within plug 83 to provide a braking movement fixedly maintaining the angular relationship of arm 17 with respect to tubular extension 18. Further, since the cable 78 is then locked, as it were, in position within bore 77 of arm 17, the angular orientation of sheave 71, and consequently of the axis of forearm 15, will remain fixed. In this way, forearm 15 can remain oriented in position to maintain iron 1 in the position in which it was last placed in its raised orientation and with iron 1 then remaining suspended by arm 17 and forearm 15 in readiness for recommencing ironing operation.

The resultant lifting of iron 1 to a convenient position in readiness for being lowered again to the ironing board surface when desired by the user provides extreme convenience and eliminates a very substantial fatigue factor which otherwise would be necessitated for the average user, such as the housewife, who when using a conventional iron would have to be constantly lifting, carrying and transferring the iron at frequent and repeated intervals throughout ironing operations. Moreover, since the tension on cable 78 is released as soon as the iron is returned to its normal position anywhere on the board, the articulating movement of arm 17 with respect to tubular extension 18 and of forearm 15 with respect to arm 17 is once more freely permitted so that the iron may be readily transferred to any point within the reach of the articulations thus provided, as dependent upon the selected length of cable 78. Hence, cable 78 is preselected in dimension to provide for the freedom of movement requisite for iron 1 to be readily moved to any point on the ironing board surface.

Since at all times spring 60 maintains unit 9 in a pretensioned state providing a constant lifting force upon iron 1, the user need only apply the slightest of pressure upward upon handle portion 4 to swing the iron from the position shown in FIG. 6 to that demonstrated in FIG. 5, at which point the heel 8 of the iron will be lifted free of the ironing board surface and the iron will assume a suspended condition and with its weight tensioning cable 78, as explained above, to conveniently fix the position of the iron in its suspended position at a point of readiness for once more being returned to a position of use upon the ironing board surface, such as after the user has reoriented an article of clothing or replaced an ironed article with one next to be ironed. Such upward pressure is much, much less than the weight of the iron, since spring 60 nearly, i.e., almost, fully compensates for the moment of the iron.

Apparatus of the invention is of a foldable character for providing compact, convenient storage when not in use. For this purpose, tubular extension 18 is axially slidable in telescoping relationship within leg 20. For maintaining extension 18 in its raised position shown in FIG. 14, it is provided with a spring button 89 extending through a hole 90 within extension 18 and biased outwardly, as by means of a leaf spring 91 or the like and, thus, presenting a shoulder or surface 92 for bearing against the lip of leg portion 20'.

Referring to FIG. 13, iron 1 has a power cord 94 which is held at elbow 16 by a suitable clamp 95 affixed appropriately to housing 73. Cord 94 is, thus, maintained conveniently out of the way during ironing operations. Cord 94 is also secured to leg portion 20' by a further clamp 96 of suitable configuration. Accordingly, upon the arm 17 being raised from its stored position telescoping enclosed within leg 20, movement of arm 17 upwardly is permitted until the section of cord between clamps 95 and 96 becomes taut, limiting further upward movement and so precluding tubular extension 18 from being pulled upwardly out of the upper end 20' of the leg.

Figure 12:
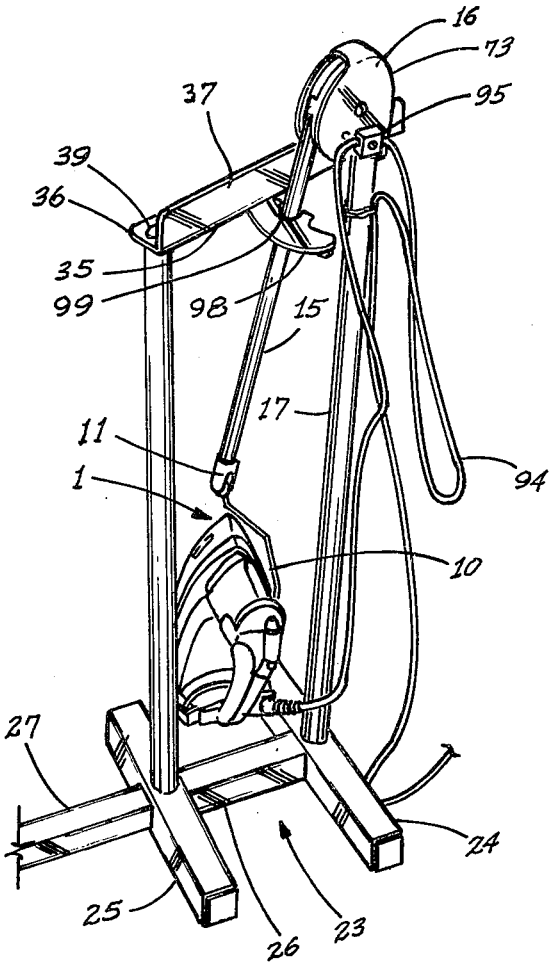
FIG. 12 is a perspective view of apparatus of the invention, as observed from the rear, demonstrating certain iron support components thereof in a stored position.

For storage of ironing apparatus A, spring button 89 is pressed inward to clear the lip 91 of leg portion 20' and arm 17, having been swung into axial alignment with tubular extension 18, may now be lowered telescopingly into leg 20 to a storage position depicted in FIG. 12 wherein leg 20 receives the entire length of arm 17 and with housing 73 now resting on lip 91 of the leg. Further, arm 15 extends downwardly from elbow 16 in a position presenting iron 1 substantially intermediate legs 20, 20' and maintaining the iron in a suspended condition, where it safely not in contact with other structure. Hence, the apparatus may be folded for storage even though iron 1 is still hot.

A novel arrangement for locking forearm 15 in the position demonstrated in FIG. 12 is provided by a lever 98 having a notch 99 for accommodating the forearm and swingable about the axis of locking pin 38.

Figure 15:
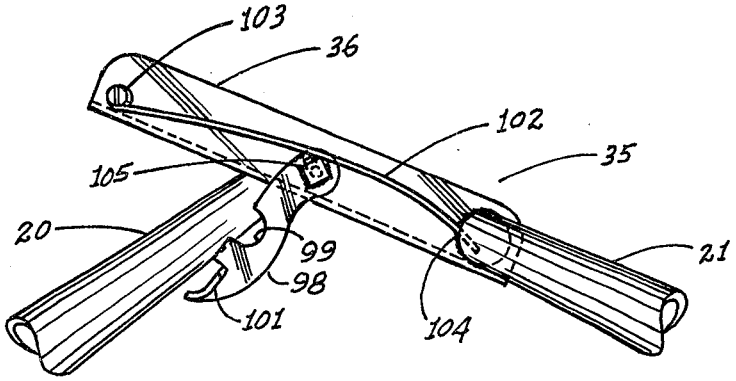
FIG. 15 is a bottom view of certain ironing board securement features of the invention.
Figure 16:
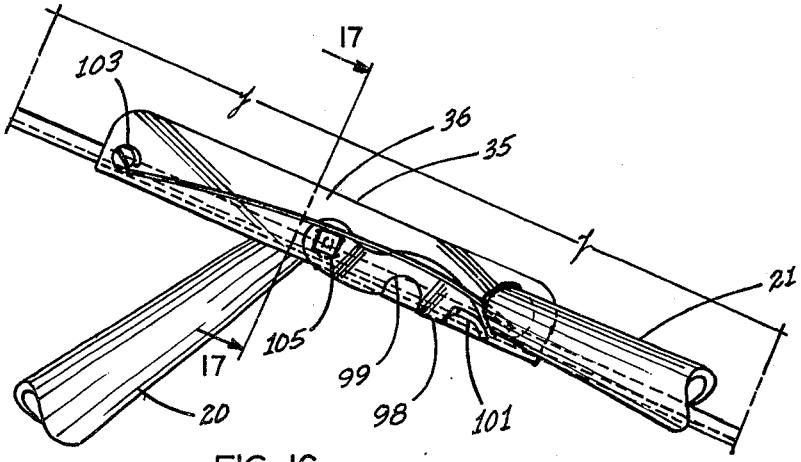
FIG. 16 is a similar bottom view illustrating components of the securement features in a position for interengagement of the apparatus with an ironing board.
Figure 17:
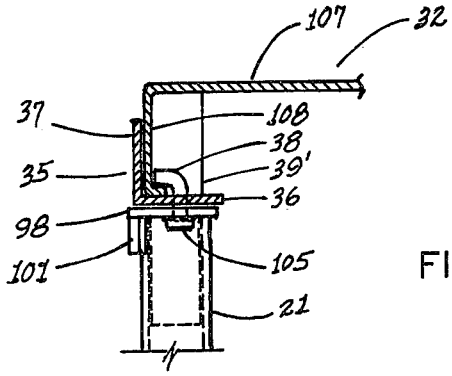
FIG. 17 is a transverse cross-sectional view taken along line 17—17 of FIG. 16.

Referring to FIGS. 15–17, the configuration of lever 98 is more clearly seen. It includes a tab or flange 101 providing a surface for convenient application of force for movement between the positions shown in FIGS. 15 and 16. For maintaining said arm 98 in position against the bottom surface of the horizontal flange 36 of bracket 35, there is provided a spring wire 102 having one end connected to the bracket by a screw, rivet or other suitable fitting 103 and the other end being extended through an aperture 104 in the wall of leg 21. Further, locking pin 38 is provided with a head 104 of generally rectangular configuration against which spring wire 102 is resiliently urged, tending to maintain arm 98 in a position either aligned with the longitudinal axis of bracket 35, as in FIG. 16, or as (as shown in FIG. 12) in a position in which notch 99 or arm 98 engages forearm 15.

Figure 3:
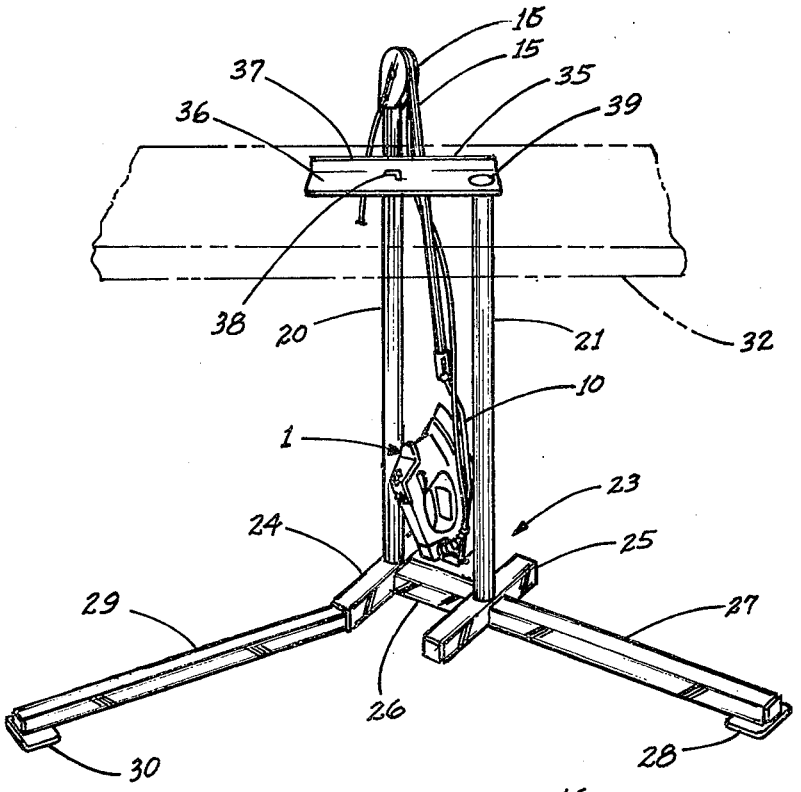
FIG. 3 is a perspective view of ironing apparatus of the invention as oriented for use and with certain support members secured to the apparatus prior to iron lifting members being unfolded from their stored position.

The mechanism for interengagement of an ironing board, as designated at 32 in FIGS. 3 and 4, to bracket 35 is now apparent. The tubular extension 39' of the ironing board is inserted in leg aperture 39, as will be seen in FIG. 17. Ironing board 32 is shown simplistically in FIG. 17 as having merely an upper surface 107 and a vertical or side edge or flange 108, although, as would be understood, a padding layer and cover are, in actuality, present. Dog or finger 38 is oriented relative to arm 98 so that it will be directed toward horizontal flange (See FIG. 17) when lever 98 is oriented substantially in line with bracket 35. However, for interengaging the bracket 35 and ironing board 32, arm 98 is oriented first as shown in FIG. 15 with dog or finger 38 being then directed parallel to side edge 108. The side edge 108 is now adjacent vertical flange 37 of bracket 35. Handle 98 is then swung from the position in FIG. 15 to the position in FIG. 16, thus, bringing locking finger 38 into engagement with wall 108 for clampingly engaging it between upright web 37 and the distal end of finger 38. Ironing board 32 is then locked in place and reliably maintained in the position demonstrated in FIG. 4, providing a stable, convenient orientation permitting swinging of arm 17 about the longitudinal axis of leg 20 to present iron 1 conveniently for being placed at any desired location on board 32 during ironing operations.

Such locking arrangement also makes possible the use of apparatus A with conventional ironing board 40, as FIG. 18 has illustrated. Lever 98 is similarly turned to bring locking finger 38 into engagement with the usual upright flange (not shown) of the conventional ironing board, which, thus, presents a side edge 109 which is seated against bracket 35. Also, a conventional ironing board, as at 40, has the usual legs 111, 112 having elongated extensions 111', 112' at their extremities for providing a stable base of support for ironing board 40. Accordingly, when apparatus A is clampingly interengaged in the above-described manner with ironing board 40, the use of feet 27, 29, as previously described, is obviated, as FIG. 18 demonstrates.

In view of the foregoing, it will be seen that the various objects of the invention and other advantageous results are obtained.

Although the foregoing includes a description of the best mode contemplated for carrying out the invention, various changes and modifications are contemplated.

Since it is understood that changes and modifications in the formation, construction, arrangement, and combination of the various parts of the ironing apparatus of this invention may be made and substituted for those herein shown and described without departing from the nature and principle of this invention. The description, accordingly, shall be interpreted as illustrative rather than limiting.

What is claimed is:

1. Ironing apparatus for supporting a hand iron above the ironing surface of an ironing board and characterized by a base for supportive disposition upon a supporting surface, at least one upright post member extending upwardly from said base, means for securing an ironing board in a use position proximate said post member with said ironing surface horizontally disposed for ironing thereon, an articulated linkage swingably inter-engaged at one end with said post member and extendable by articulation to positions over said ironing surface, securement means pivotally interconnecting the other, post-remote end of said linkage with said iron for permitting movement of said iron between first and second orientations respectively in and out of contact with said ironing surface, said linkage being swingable about said post member and providing articulation when said iron is in said first orientation for freely permitting relocation of said iron to desired positions over said linkage surface, and means associated with said linkage for preventing articulation when said iron is in said second orientation to maintain said iron out of contact with said ironing surface.

2. Ironing apparatus according to claim 1 and further characterized by said post member being of tubular configuration, said linkage comprising at least one tubular member telescopingly received within said post member to provide a telescopingly relationship therewith for movement between use and storage positions.

3. Ironing apparatus according to claim 1 and further characterized by said linkage comprising an arm pivotally secured to said post member for extending outward from said post member in angled relationship, a forearm pivotally connected to said arm in articulating relationship by means of an elbow, said articulation preventing means comprising a braking mechanism in said elbow for preventing articulation of said forearm relative to said arm in response to the weight of said iron pulling down from said forearm when in said second orientation.

4. Ironing apparatus according to claim 3 and further characterized by said braking mechanism comprising a cable interconnecting said forearm and said post member and disposed for being placed under increased tension in response to said weight of said iron pulling down from said forearm.

5. Ironing apparatus according to claim 4 and further characterized by said elbow including a cable sheave rigidly secured to said forearm and pivotal with respect to said arm, said cable passing at least partly around said sheave to provide friction preventing rotation of said sheave and thereby said articulation upon said cable tensioning.

6. Ironing apparatus according to claim 3 and further characterized by said post member being of tubular configuration, said arm being also of tubular configuration and having a first lower portion telescopingly received by said post member, a second, upper portion hingedly affixed to said first portion and adapted for aligning with said first portion and also telescoping receivable by said post member for storage but forming an angle with said first portion and said post member for use.

7. Ironing apparatus according to claim 6 and further characterized by a further upright post member extending upwardly from said base and spaced from the first-said post member, said means for securing an ironing board comprising a bracket transversely carried at the upper end of said further post member, and a locking device associated with said bracket for clampingly interengaging said bracket and a side edge of said ironing board.

8. Ironing apparatus according to claim 1 and further characterized by said securement means comprising a fitting for attachment to said iron, a transverse shaft rotatably interengaging said fitting and a forearm extension interconnecting said shaft with the post-remote end of said linkage, said iron being rotatable about said shaft for movement between said first and second orientations, said second orientation providing an upstanding disposition of said iron, and a spring wound about said shaft for resiliently urging said iron for movement from the first to the second orientation, said spring being pretensioned to substantially nearly compensate for the moment of said iron normally maintaining said iron in said first orientation, whereby said iron will move from said first to said second orientation upon slight upward force exerted by the user on said iron which force is much, much less than the weight of said iron.

9. Ironing apparatus according to claim 8 and further characterized by said forearm extension being interconnected by a swivel with the post-remote end of said linkage.

10. Ironing apparatus according to claim 8 and further characterized by said iron having a handle, said fitting including a bracket including a band adapted for being tightened to be clampingly secured about said handle thereby to grippingly secure said handle in pivotal relationship to said shaft.

11. Ironing apparatus according to claim 10 and further characterized by said bracket having projections for engaging said forearm extension to define the limits of movement of said iron in said first and second orientations, said transverse shaft being shiftable relative to said bracket for permitting clearance between said projections and said forearm extension for thereby permitting free rotation of said iron about the axis of said transverse shaft for pretensioning of said spring.

12. Ironing apparatus for supporting a hand iron above the ironing surface of an ironing board and characterized by a base for supportive disposition upon a supporting surface, at least one upright post member extending upwardly from said base, means for securing an ironing board in a use position proximate said post member with said ironing surface horizontally disposed for ironing thereon, an articulated linkage swingably interengaged at one end with said post member and extendable by articulation to positions over said ironing surface, securement means pivotally interconnecting the other, post-remote end of said linkage with said iron for permitting movement of said iron between first and second orientations respectively in and out of contact with said ironing surface, said linkage being swingable about said post member and providing articulation when said iron is in said first orientation for freely permitting relocation of said iron to desired positions over said linkage surface, said linkage including means for preventing articulation when said iron is in said second orientation to maintain said iron out of contact with said ironing surface, and said linkage including an arm pivotally secured to said post member for extending outward from said post member in angled relationship, a forearm pivotally connected to said arm in articulating relationship by means of an elbow, said elbow including a braking mechanism for preventing articulation of said forearm relative to said arm in response to the weight of said iron pulling down from said forearm when in said second orientation, said securement means including a fitting for attachment to said iron, a transverse shaft rotatably interengaging said fitting and a forearm extension interconnecting said shaft with the post-remote end of said linkage, said iron being rotatable about said shaft for movement between said first and second orientations, said second orientation providing an upstanding disposition of said iron, and a spring wound about said shaft for resiliently urging said iron for movement from the first to the second orientation, said spring being pretensioned to substantially nearly compensate for the moment of said iron normally maintaining said iron in said first orientation, whereby said iron will move from said first to said second orientation upon slight upward force exerted by the user on said iron which force is much, much less than the weight of said iron.

13. Ironing apparatus according to claim 12 wherein said base is comprised of tubular members and further including a plurality of foot members adapted for engaging the tubular members of said base in telescoping relationship, said foot members extending outwardly from said base beneath said ironing board.

* * * * *

UNITED STATES PATENT AND TRADEMARK OFFICE

CERTIFICATE OF CORRECTION

PATENT NO. : 4,438,577

DATED : March 27, 1984

INVENTOR(S) : Edwin E. Foster et al

It is certified that error appears in the above-identified patent and that said Letters Patent is hereby corrected as shown below:

Claim 8, column 10, line 54, "moment" should be ---movement---

Claim 12, column 12, line 20, "moment" should be ---movement---.

Signed and Sealed this

*Second* Day of *April 1985*

[SEAL]

*Attest:*

DONALD J. QUIGG

*Attesting Officer*

*Acting Commissioner of Patents and Trademarks*